US009348316B2

(12) United States Patent
Meier et al.

(10) Patent No.: US 9,348,316 B2
(45) Date of Patent: May 24, 2016

(54) MOVEMENT FOR MECHANICAL CHRONOGRAPH WITH QUARTZ REGULATOR

(71) Applicant: RICHEMONT INTERNATIONAL S.A., Villars-sur-Glane (CH)

(72) Inventors: Willy Meier, Fontaines (CH); Alexandre Michalet, Chaux des pres (FR); Kurt Straumann, Langendorf (CH); Daho Taghezout, Morges (CH)

(73) Assignee: Richemont International SA (CH)

( * ) Notice: Subject to any disclaimer, the term of this patent is extended or adjusted under 35 U.S.C. 154(b) by 0 days.

(21) Appl. No.: 14/424,468

(22) PCT Filed: Sep. 18, 2013

(86) PCT No.: PCT/EP2013/069402

§ 371 (c)(1),
(2) Date: Feb. 27, 2015

(87) PCT Pub. No.: WO2014/048819

PCT Pub. Date: Apr. 3, 2014

(65) Prior Publication Data

US 2015/0220064 A1 Aug. 6, 2015

(30) Foreign Application Priority Data

Sep. 25, 2012 (CH) ..... 1734/12

(51) Int. Cl.
*G04C 3/04* (2006.01)
*G04F 8/04* (2006.01)
*G04C 10/00* (2006.01)

(52) U.S. Cl.
CPC *G04C 3/04* (2013.01); *G04C 10/00* (2013.01); *G04F 8/04* (2013.01)

(58) Field of Classification Search
CPC ..... G04C 3/00; G04C 3/008; G04C 3/04; G04C 10/00; G04F 8/04; G04F 8/006; G04F 8/02
See application file for complete search history.

(56) References Cited

U.S. PATENT DOCUMENTS 3,937,001 A * 2/1976 Berney ..... G04C 10/00 318/147
4,211,066 A * 7/1980 Kusumoto ..... G04C 3/146 368/101
5,517,469 A 5/1996 Wiget
(Continued)

FOREIGN PATENT DOCUMENTS

CH A-597636 4/1978
CH 695400 4/2006
(Continued)

OTHER PUBLICATIONS

Electronic English Translation of Gilles, CH 695400, translated Sep. 22, 2015.*

*Primary Examiner* — Amy Cohen Johnson
*Assistant Examiner* — Matthew Powell
(74) *Attorney, Agent, or Firm* — Blank Rome LLP

(57) ABSTRACT

Movement for chronograph watch comprising: a barrel (1); a main gear train (RH) for driving one or more current time indicators (43); a regulator member comprising a generator (8) driven by the main gear train (RH), the generator powering an electronic regulation circuit (80) to control the speed of rotation of the main gear train as a function of a quartz oscillator (81); a chronograph gear train (Rc) that can be brought into mesh with the main gear train (RH) to drive a timer indicator (152). The chronograph gear train can be brought into mesh with a wheel (8) that performs more than one revolution per minute.

7 Claims, 2 Drawing Sheets

(56) References Cited

U.S. PATENT DOCUMENTS

| | | | | |
|---|---|---|---|---|
| 5,751,666 | A * | 5/1998 | Farine | G04C 10/04 368/140 |
| 6,124,649 | A | 9/2000 | Schafroth | |
| 6,208,119 | B1 | 3/2001 | Schafroth | |
| 6,244,742 | B1 * | 6/2001 | Yamada | G04C 3/008 368/148 |
| 6,714,487 | B2 | 3/2004 | Schafroth et al. | |
| 6,744,699 | B2 * | 6/2004 | Klein | G04C 10/00 368/203 |
| 2002/0064097 | A1 * | 5/2002 | Wyssbrod | G04B 13/02 368/88 |
| 2005/0041535 | A1 | 2/2005 | Hiraya | |

FOREIGN PATENT DOCUMENTS

| | | |
|---|---|---|
| EP | 0239820 | 10/1987 |
| EP | 0679968 | 11/1995 |
| EP | 0816955 | 1/1998 |
| EP | 0851322 | 7/1998 |
| WO | WO0063749 | 10/2000 |

* cited by examiner

MOVEMENT FOR MECHANICAL CHRONOGRAPH WITH QUARTZ REGULATOR

RELATED APPLICATION

This application is a National Phase of PCT/EP2013/069402, filed on Sep. 18, 2013 which claims priority to Switzerland Patent Application No. 1734/12, filed Sep. 25, 2012. The entire disclosures of those applications are hereby incorporated by reference.

TECHNICAL FIELD

The present invention concerns a regulator member for a wristwatch, notably an electronic regulator member for a mechanical wristwatch.

STATE OF THE ART

Mechanical wristwatches are usually regulated by means of an assembly comprising a spiral and a balance. The precision that can be achieved by means of a regulator member of this type, however, is limited.

Electronic watches are usually regulated by means of a quartz oscillator. The accuracy that can be achieved is greater than that of mechanical movements, but these watches usually require a battery that needs to be replaced periodically.

In order to overcome these drawbacks, the state of the art also knows watches that comprise a mechanical movement regulated by an electronic circuit with a quartz oscillator. The energy required for the electronic circuit is supplied by a microgenerator driven by the movement.

Thus, CH-A-597636 (Ebauches S. A.) proposes a mechanical movement with a barrel spring and a generator. The spring actuates, by means of a gearing, a time indicator and the generator that supplies an alternating voltage. The generator powers a rectifier that charges a storage capacity in order to power a quartz oscillator as well as an electronic regulation circuit. The electronic regulation circuit comprises a logical comparison circuit and an energy dissipation circuit connected to the output of the logical comparison circuit, whose power absorption can be controlled by the logical comparison circuit. An input of the logical comparison circuit is connected to the reference circuit and another input of the logical comparison circuit is connected to the generator. Depending on the result of this comparison, the logical comparison circuit controls the power absorption by the energy dissipation circuit and thus regulates, by means of controlling the regulating circuit's energy absorption, the running of the generator and of the time indicator.

In such a watch, the advantages of a mechanical watch, i.e. the absence of batteries, are combined with the accuracy of a quartz watch.

EP-A-0239820 and EP-A-679968 describe different electronic circuits to control the speed of a microgenerator in which a control circuit continuously monitors the angular position of the rotor and brakes it as soon as its angular position is in advance. Due to their sensitivity to errors and phase variations of the components, these circuits are difficult to adjust.

EP816955 describes an improvement over the electronic circuits controlling watch microgenerators, wherein the voltage rectifier comprises transistors controlled by comparators to replace the diodes after the circuit has started.

EP0851322 describes a microgenerator for watch movement comprising a stator with three electrically connected coils and a rotor provided with magnetized areas. The coils are placed in an asymmetric manner around the shaft of the rotor in order to facilitate assembly.

WO0063749, the contents whereof are incorporated by reference, describes a watch movement with a microgenerator. In order to avoid the accumulation of electric charges, the wheels and the geartrain pinions are electrically grounded (connected electrically to the plate) and made of a non-magnetic material.

The above documents relate to watches that display the current time. However, it is also known to use a regulator member based on a generator and a quartz oscillator to regulate the running of a mechanical chronograph watch. One solution of this type is described in U32005/0041535. In this document, a chronograph function can be added to an existing movement by means of a chronograph geartrain that engages with the seconds' hand of the main geartrain when the chronograph is started, and which is disconnected when the chronograph is not used.

The most sophisticated mechanical chronographs currently available make it possible to count elapsed time with a very fine resolution, for example a resolution on the order of hundredths or even thousandths of a second. It is however difficult to maintain such accuracy for a long period of time with a purely mechanical regulating member. It would therefore be desirable to make a mechanical chronograph regulated by a quartz oscillator, whose construction is adapted for measuring time with very fine resolutions, for example resolutions on the order of tenths, hundredths or even thousandths of a second.

BRIEF SUMMARY OF THE INVENTION

One aim of the present invention is to propose a movement for mechanical chronograph watch, quartz-regulated, that offers a high precision and that is adapted for measuring elapsed time with a fine resolution.

A construction of movement for a mechanical chronograph watch, quartz-regulated, that enables these first aims to be achieved, is illustrated in FIG. 1, which illustrates diagrammatically a cross section view of an example of geartrain for such a mechanical chronograph watch with electronic regulation. The geartrain comprises a main geartrain $R_H$ designed for displaying the current time (hours, minutes, seconds), as well as a chronograph geartrain $R_C$ designed for displaying the lengths of time measured by the chronometer. The chronograph geartrain is driven by the seconds' wheel 4 of the main geartrain $R_H$ only when the chronograph is started; in the opposite case, it is disconnected.

Reference 1 indicates a barrel with the barrel winding 10 and a toothing 11 that meshes with the center wheel pinion 20 on the center wheel disc 2. The great wheel 21 meshes with its third wheel pinion 30 onto the third wheel disc 3, whose third wheel 31 meshes with the seconds' pinion 40 on the seconds' wheel 4. A seconds' hand 43 can be mounted on the seconds' wheel 4 in order to display the second of the current time.

The seconds' wheel 41 of the seconds wheel 4 meshes with the pinion 50 of the first intermediate disc 5, whose wheel 51 drives the pinion 60 of the second intermediate disc 6. This second intermediate disc 6 comprises a wheel 61 that drives the reverser connecting wheel 7 in mesh with the gear teeth 80' on the shalt of a generator 8. The generator 8 produces an electric current when it is driven, which makes it possible to power an electronic speed regulation circuit 80 in order to compare the rotation.

In order to count and display a length of time measured by the chronometer, the device of FIG. 1 further comprises a chronograph geartrain R, with a fifth disc 9 whose pinion 90 can engage with the wheel 42 of the seconds wheel 4. The fifth disc 9 performs for example one turn in six seconds. It comprises a wheel 91 that drives the pinion 120 of the sixth disc 12, performing 10 turns per second, and whose wheel drives the pinion 130, on the arbor of which is mounted a hand 131 for displaying the hundredth of a second (displaying another fraction of a second is of course also possible). In this embodiment, the hand 131 performs one turn per second.

The main geartrain $R_H$ thus enables the speed of rotation to be multiplied from the barrel 1 until the seconds' wheel 4, then between this seconds wheel and the generator 8. The chronograph geartrain $R_C$, when it is engaged, enables the speed of rotation to be multiplied from the seconds' wheel 4 up to the pinion of hundredth of a second 130.

This new construction enables the above-mentioned aims to be achieved, and notably to benefit from the precision afforded by quartz for regulating a mechanical chronograph to the hundredth of a second (or to another faction of a second).

However, a detailed study of this solution reveals that it is not yet quite optimal. Indeed, in this geartrain, the inaccuracies as to the positioning of the seconds wheel 4 are amplified 60 times through the wheels 9, 12, 13.

Furthermore, the geartrain $R_C$ between the seconds' wheel 4 and the wheel 13 for displaying the hundredths of a second comprises several driven pinions 90, 120, 130. Each of these pinions comprises a number of teeth lower than that of the wheel driving it, creating a play in the positioning. For example, the pinion 130 comprises a number of teeth considerably lower than the wheel 121 driving it. This results in a buildup of clearances that accumulate in the geartrain $R_C$ and thus in an inaccurate positioning of the hand 131 for displaying the hundredths of a second, giving the impression of floating.

An additional aim of the present invention is thus to propose a movement for chronograph watch that makes it possible to limit the play in the geartrain.

Another aim of the present invention is to propose a movement for chronograph watch that enables the hand for displaying a fraction of a second (for example the hundredths of a second) of the chronograph to be positioned in a precise manner.

According to the invention, these aims are achieved notably by means of a movement for chronograph watch comprising a barrel; a main geartrain for driving one or more current time indicators; a regulator member comprising a generator driven by the main geartrain, the generator powering an electronic regulation circuit to control the speed of rotation of the main geartrain as a function of a quartz oscillator; a chronograph geartrain that can be brought into mesh with the main geartrain to drive a timer indicator; and wherein the chronograph geartrain can be brought into mesh with a wheel of the main geartrain that performs more than one revolution per minute.

This solution makes it possible to avoid a sizable multiplication ratio between the wheel that engages onto the main geartrain and the elapsed time indicators driven by the chronograph geartrain. As the chronograph geartrain is driven by a wheel of the main geartrain turning at great speed, and at any rate faster than the seconds wheel, the multiplication necessary for displaying the timed tenths or hundredths of a second is reduced.

This results in a greater precision for displaying the length of time measured by the chronometer and a reduced sensitivity to positioning errors of the main geartrain elements. It also results in a reduced play of the wheels of the chronograph geartrain that carry the indicators of the length of time measured by the chronometer (timer indicators), notably the indicators for the tenths or hundredths of a second.

If the chronograph geartrain engages on a wheel that performs at least one turn per second, no multiplication is necessary. In an advantageous embodiment, the chronograph geartrain can be made to engage on a pinion or a wheel mounted on the shaft of the generator, i.e. on the fastest wheel connected to the main geartrain. The generator is then driven by the main geartrain, and in turn drives the chronograph's geartrain when the latter is engaged. In this case, the chronograph geartrain is thus a divisor between the seconds' wheel and the wheel for displaying the hundredths of a second. For example, in the case of a generator turning at a speed of 4 to 8 turns per second, no multiplication is necessary for displaying the hundredth of a second by means of a wheel performing a tenth of a turn per second or even a turn per second. This results in a considerably increased precision as regards the positioning of this wheel.

The main geartrain can comprise a seconds' wheel and one or several intermediate discs, with the generator being downstream of the seconds' wheel. The chronograph geartrain is arranged for being driven by one of the intermediate discs or by the generator when the chronograph is started.

Advantageously, the pinions of the portion of the chronograph geartrain $R_C$ between the coupling and the fastest wheel of the geartrain $R_C$ (for example the wheel for displaying the hundredths of a second) are all driving; this portion of the geartrain $R_C$ does not comprise driven pinions. This results in a more precise positioning of the chronograph's indicators.

Advantageously, the pinions of the chronograph geartrain $R_C$ are all driving.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
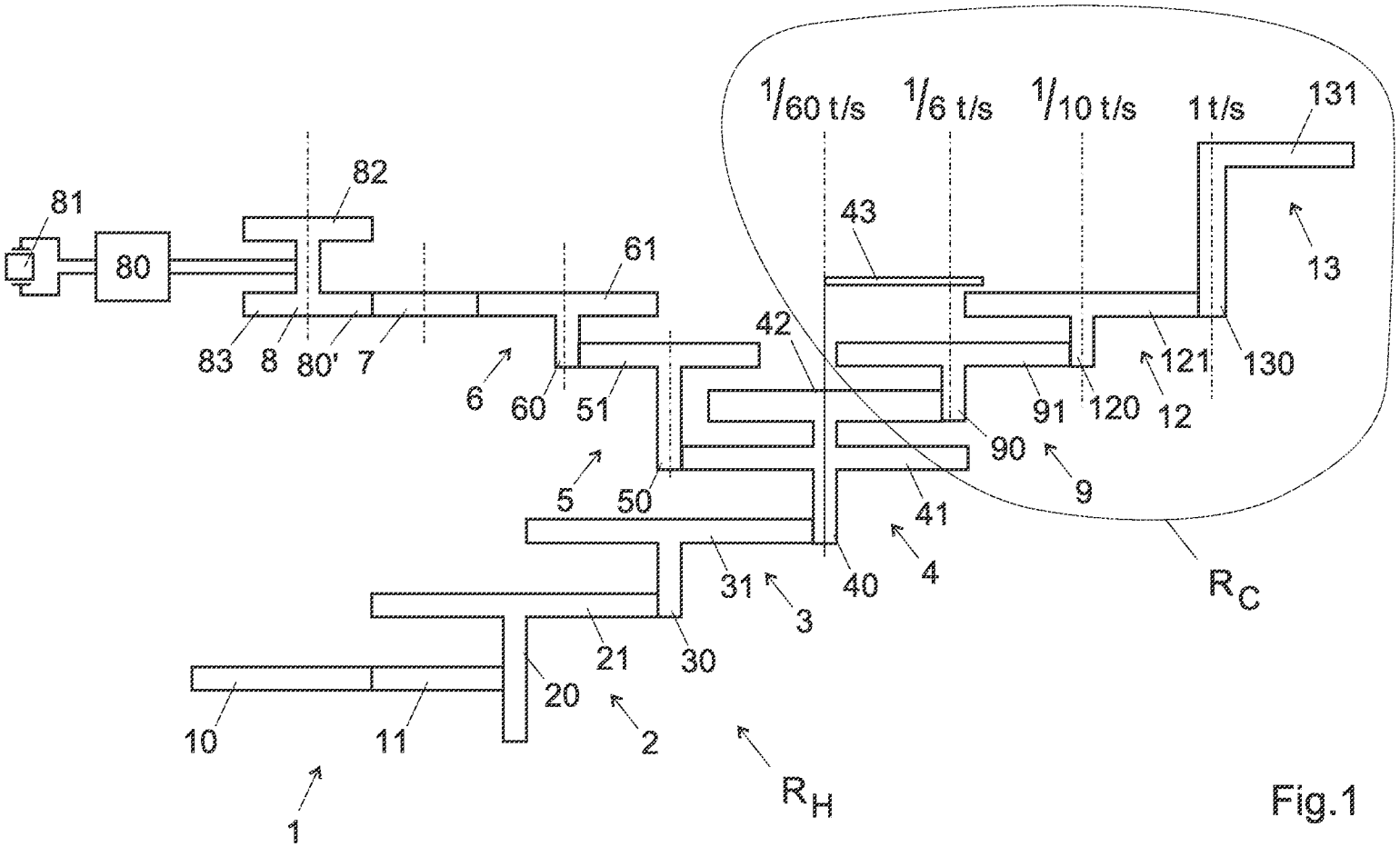
FIG. 1 illustrates diagrammatically a cross-sectional view of the principal elements of the main geartrain and of the chronograph geartrain of a mechanical chronograph watch regulated by a quartz oscillator.
Figure 2:
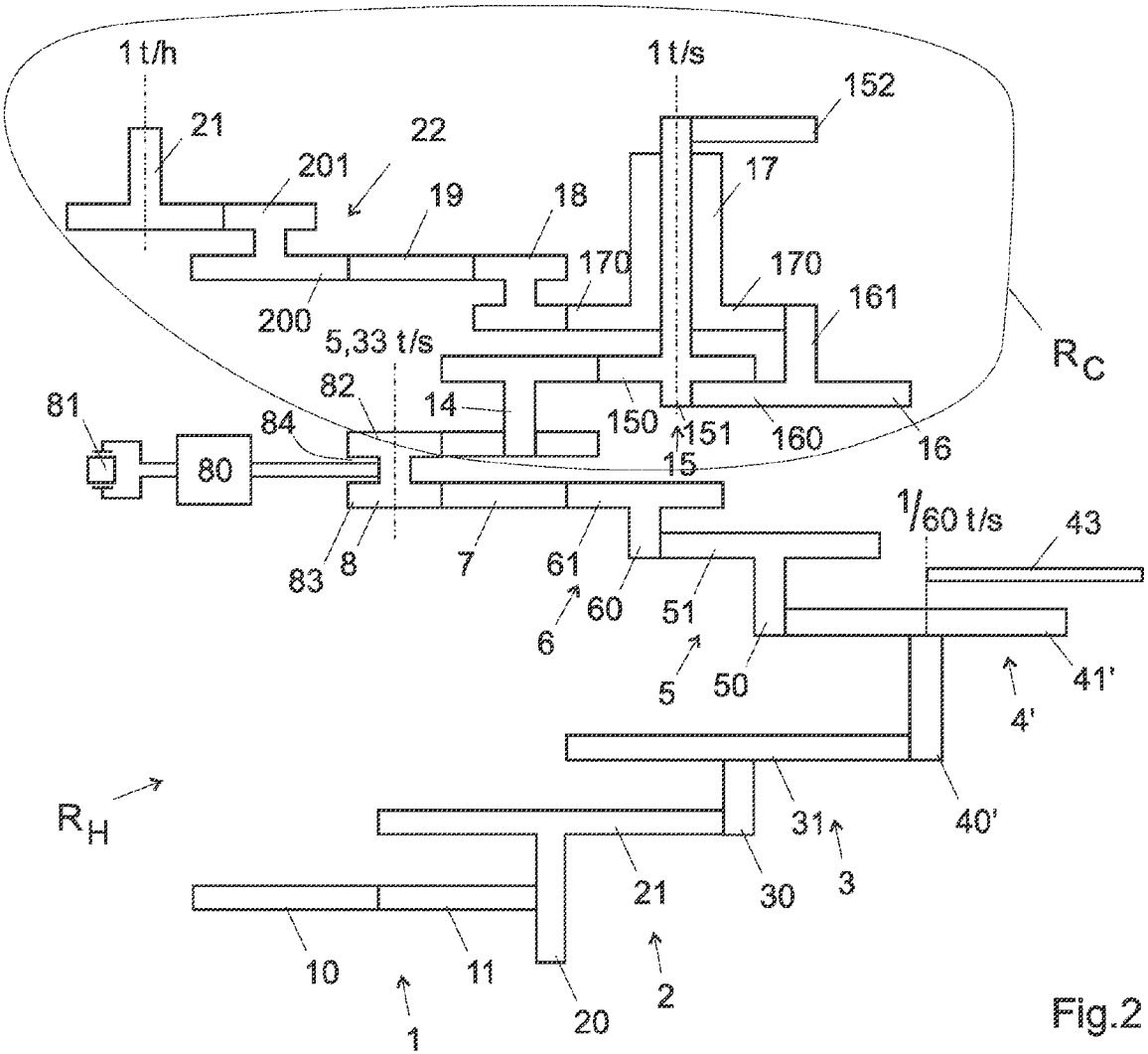
FIG. 2 illustrates diagrammatically a cross-sectional view of the principal elements of the main geartrain and of the chronograph geartrain of a mechanical chronograph watch regulated by a quartz oscillator according to the invention.

FIG. 2 illustrates diagrammatically the principal elements of the main geartrain and of the chronograph geartrain of a mechanical chronograph watch regulated by a quartz oscillator according to the invention. The elements that are identical or similar to those of FIG. 1 already described bear the same reference numbers.

The movement comprises a main geartrain $R_H$ that is permanently driven for displaying the time when the watch is running, as well as a chronograph geartrain $R_C$ that is engaged by the main geartrain only when the chronograph is started; the rest of the time, the chronograph geartrain $R_C$ is stopped.

Connected to the main geartrain $R_H$, a barrel 1 with a winding 10 and a barrel toothing 11 stores in a mechanical form the energy necessary for the running of the watch and of the chronograph. The barrel can be wound up for example thanks to a winding crown or by an automatic winding system with an oscillating mass. The toothing 11 meshes with the pinion 20 of the center wheel disc 2 whose wheel 21 drives the pinion 30 of the third wheel disc 3. This third wheel disc 3 also has a third wheel 31 that meshes with the seconds pinion 40' on the seconds wheel 4'. The seconds' wheel is regulated to perform one turn in 60 seconds and carries the seconds' hand 43.

Regulating the seconds' wheel is done through the first intermediate disc 5 carrying the pinion 50 and the wheel 51, of the second intermediate disc 6 with the pinion 60 and the wheel 61, and of the reverser pinion 7 that drives the generator 8. This portion of the geartrain enables the speed of rotation to be multiplied up to the generator.

The generator 8 comprises for example a rotor with two magnetic plates 82, 83 whose rotation produces a rotating magnetic field on the coils of the stator 84. The electronic regulating circuit 80 compares the frequency or phase of the alternating voltage induced in these coils with the frequency or phase of a reference signal supplied by a quartz oscillator 81. If the rotor is in advance, i.e. if the geartrain turns too quickly, the electronic circuit 80 reduces the load impedance faced by the coils, so as to short-circuit them at least partially and thus brake the rotor.

In this embodiment, the chronograph geartrain $R_C$ comprises a coupling 14 that meshes directly onto a wheel or a pinion mounted on the shaft of the generator 8, or even on the rotor of the generator, when the chronograph is started. The coupling 14 drives the disc 15 with its wheel 150 and its pinion 151; in one advantageous embodiment, the disc 15 performs one turn per second and enables the timed hundredths of a second to be indicated, by means of the hand 152 for displaying the hundredths of a second pointing onto a corresponding index.

The pinion 151 drives the wheel 160 of the driver 16 of the seconds counter, whose pinion 161 drives the wheel 170 of the seconds wheel of the chronograph 17, which here is coaxial to the wheel 15 and performs one turn per minute in order to display the seconds measured by the chronometer. An intermediate wheel 18 and a reverser pinion 19 then make it possible to drive the disc 21 of the minutes counter, which performs for example one turn per hour to indicate the minutes measured by the chronometer. The disc 22 with its pinion 201 and its wheel 200 is placed between the reverser pinion 19 and the disc 21; it is advantageously positioned by a jumper.

In the manner described in WO0063749, the geartrain wheels $R_H$ and $R_C$ are preferably all connected electrically to the movement's plate, in order to avoid the accumulation of electric charges and a van-den-Graaf effect. At least the discs closest to the rotor 82, 83 are advantageously made of non-magnetic material in order to not negatively affect the magnetic field.

The invention claimed is:

1. A movement for a chronograph watch comprising:

a barrel;

a main geartrain for driving one or more current time indicators;

a regulator member comprising a generator driven by the main geartrain, the generator powering an electronic regulation circuit to control the speed of rotation of the main geartrain as a function of a quartz oscillator;

a chronograph geartrain that can be bought into mesh with the main geartrain to drive a timer indicator;

wherein the chronograph geartrain can be brought directly into mesh with a wheel of the generator that performs more than one revolution per minute.

2. The movement according to claim 1, wherein the chronograph geartrain can be made to engage on a wheel on the shaft of the generator.

3. The movement according to claim 1, wherein the chronograph geartrain comprises a disc arranged to perform at least one tenth of a turn per second, in order to display fractions of seconds of the chronograph such as tenths or hundredths.

4. The movement according to claim 1, wherein the main geartrain comprises a seconds' wheel and one or several intermediate discs as well as the generator downstream of the seconds' wheel.

5. The movement according to claim 4, wherein the chronograph geartrain is arranged to be driven by one of the intermediate discs or by the generator only when the chronograph is started.

6. The movement according to claim 1, wherein the chronograph geartrain comprises a coupling for engaging it on the main geartrain, and in that the portion of the chronograph geartrain between the coupling and the fastest wheel of the geartrain does not comprise driven pinions.

7. The movement according to claim 1, wherein the chronograph geartrain comprises driving pinions.

* * * * *